US008429873B2

(12) United States Patent
Devine, Jr.

(10) Patent No.: US 8,429,873 B2
(45) Date of Patent: Apr. 30, 2013

(54) MODULAR CONSTRUCTION PANELS, SYSTEMS, AND METHODS OF INSTALLATION

(76) Inventor: Timothy P. Devine, Jr., Lenexa, KS (US)

( * ) Notice: Subject to any disclaimer, the term of this patent is extended or adjusted under 35 U.S.C. 154(b) by 1116 days.

(21) Appl. No.: 12/252,074

(22) Filed: Oct. 15, 2008

(65) Prior Publication Data

US 2010/0088972 A1 Apr. 15, 2010

(51) Int. Cl.
*E04B 2/46* (2006.01)
*E04B 2/00* (2006.01)
*E04B 1/00* (2006.01)

(52) U.S. Cl.
USPC ..... 52/592.1; 52/284; 52/588.1

(58) Field of Classification Search ..... 52/592.1, 52/284, 581, 588.1, 589.1, 591.1
See application file for complete search history.

(56) References Cited

U.S. PATENT DOCUMENTS

| | | | | |
|---|---|---|---|---|
| 2,823,433 | A * | 2/1958 | Kendall | 52/591.1 |
| 4,067,164 | A | 1/1978 | McMillan | |
| 4,290,246 | A * | 9/1981 | Hilsey | 52/169.1 |
| 4,592,182 | A | 6/1986 | Felser | |
| 4,640,069 | A | 2/1987 | Felser | |
| 4,769,963 | A | 9/1988 | Meyerson | |
| 4,944,127 | A | 7/1990 | Clear | |
| 5,195,287 | A | 3/1993 | Bruggink | |
| 5,263,252 | A | 11/1993 | Bruggink | |
| 5,356,242 | A * | 10/1994 | Elmore et al. | 405/262 |
| 5,701,708 | A * | 12/1997 | Taraba et al. | 52/309.9 |
| 5,862,640 | A * | 1/1999 | Negri | 52/565 |
| 5,928,724 | A | 7/1999 | Descamps et al. | |
| 6,125,597 | A * | 10/2000 | Hoffman et al. | 52/169.12 |
| 6,581,351 | B2 * | 6/2003 | DeVivi | 52/592.1 |

FOREIGN PATENT DOCUMENTS

| | | | |
|---|---|---|---|
| EP | 0715037 | A1 | 6/1996 |
| JP | 07292944 | A | 11/1995 |
| JP | 08004262 | A | 1/1996 |
| JP | 02620153 | B2 | 3/1997 |
| WO | 0040818 | A1 | 7/2000 |
| WO | 2008133377 | A1 | 11/2008 |

OTHER PUBLICATIONS

Panelized Home Directory, www.nahb.org, last updated Feb. 10, 2008. National Association of Home Builders (NAHB).
Panelized Home Directory, www.nahb.org, last updated Jan. 4, 2008. National Association of Home Builders (NAHB).

(Continued)

*Primary Examiner* — William Gilbert
(74) *Attorney, Agent, or Firm* — Lathrop & Gage LLP

(57) ABSTRACT

Modular construction panels, systems, and methods of installation are set forth for use in creating buildings. A modular construction panel includes a panel having a height, opposed faces, and opposed generally vertical ends. In one embodiment, a keyway receiver is integral with the panel adjacent one of the ends, and a keyway spline is integral with the panel adjacent the other end. In another embodiment, a keyway receiver is integral with the panel adjacent one of the ends. In still another embodiment, a keyway receiver is integral with the panel adjacent one of the ends. One modular construction system includes first and second panels, each having: a height, opposed faces, opposed generally vertical first and second ends, a keyway receiver at the first end or one of the faces adjacent the first end, and a keyway spline at the second end or one of the faces adjacent the second end.

23 Claims, 19 Drawing Sheets

OTHER PUBLICATIONS

Panlized Wall Systems: Making the Connections, Aug. 10, 2006. Prepared by Steven Winter Associates, Inc. for U.S. Department of Housing and Urban Development Office of Policy Development and Research, Washington, D.C.

Integrating Panels into the Production Homebuilding Process, Sep. 2005. Prepared by Steven Winter Associates, Inc. for U.S. Department of Housing and Urban Development Office of Policy Development and Research, Washington, D.C.

The AB Engineered Home Builder Directory List One Jul. 2005, Automated Builder Aug. 2005.

Listing of Panelized Building Component Companies.

International Search Report and Written Opinion issued in related PCT Patent Application Serial No. PCT/US2009/060873, May 28, 2010.

* cited by examiner

MODULAR CONSTRUCTION PANELS, SYSTEMS, AND METHODS OF INSTALLATION

BACKGROUND

The present invention relates generally to modular construction systems used to create buildings, such as single-family housing, multi-family housing, commercial buildings, retail buildings, restaurant and hospitality buildings, religious buildings, institutional buildings, educational buildings, etc.

SUMMARY

A modular construction panel according to one embodiment includes a panel having a height, opposed first and second faces, and opposed generally vertical ends. A keyway receiver is integral with the panel adjacent one of the panel ends, and a keyway spline is integral with the panel adjacent another of the panel ends. The keyway receiver includes a generally planar proximal face, a first offset face, and a second offset face. The proximal face extends generally vertically and has opposed ends. The first offset face extends from one of the proximal face ends, and the first offset face is generally vertical. The first offset face is angled relative to the proximal face to form an opening of more than ninety degrees between the first offset face and the proximal face. The second offset face extends from another of the proximal face ends, and the second offset face is generally vertical. The second offset face is angled relative to the proximal face to form an opening of more than ninety degrees between the second offset face and the proximal face. The angle of the opening between the second offset face and the proximal face is at least thirty percent greater than the angle of the opening between the first offset face and the proximal face. A generally vertical wall extends from the keyway receiver first offset face, and another generally vertical wall extends from the keyway receiver second offset face. The wall extending from the keyway receiver first offset face, the wall extending from the keyway receiver second offset face, and the proximal face are generally parallel. The wall extending from the keyway receiver second offset face is inset toward the proximal face from the wall extending from the keyway receiver first offset face. The keyway spline includes a generally planar distal face, a first offset face, and a second offset face. The distal face extends generally vertically and has opposed ends. The first offset face extends from one of the distal face ends, and the first offset face is generally vertical. The first offset face is angled relative to the distal face more than ninety degrees and less than one hundred and eighty degrees. The second offset face extends from another of the distal face ends, and the second offset face is generally vertical. The second offset face is angled relative to the distal face more than ninety degrees and less than one hundred and eighty degrees. The angle between the second offset face and the distal face is at least thirty percent greater than the angle between the first offset face and the distal face. A generally vertical wall extends from the keyway spline first offset face, and another generally vertical wall extends from the keyway spline second offset face. The wall extending from the keyway spline first offset face, the wall extending from the keyway spline second offset face, and the distal face are generally parallel. The wall extending from the keyway spline second offset face is outset toward the distal face from the wall extending from the keyway spline first offset face.

A modular construction panel according to another embodiment includes a panel and a keyway receiver. The panel has a height, opposed first and second faces, and opposed first and second generally vertical ends, and the keyway receiver is integral with the panel at either the panel first end or one of the panel faces adjacent the panel first end. The keyway receiver is between first and second generally vertical walls that are either generally perpendicular to the panel faces or that comprise one of the panel faces. The keyway receiver includes a generally planar proximal face, a first offset face, and a second offset face. The proximal face extends generally vertically and has opposed first and second ends. The first offset face extends from the proximal face first end to the first wall. The first offset face is generally vertical and is angled relative to the proximal face to form an opening of more than ninety degrees between the first offset face and the proximal face. The second offset face extends from the proximal face second end to the second wall. The second offset face is generally vertical and is angled relative to the proximal face to form an opening of more than ninety degrees between the second offset face and the proximal face. The angle of the opening between the second offset face and the proximal face is at least twenty five percent greater than the angle of the opening between the first offset face and the proximal face. The second wall is inset toward the proximal face from the first wall.

A modular construction panel according to still another embodiment includes a panel and a keyway spline. The panel has a height, opposed first and second faces, and opposed first and second generally vertical ends. The keyway spline is integral with the panel at either the panel first end or one of the panel faces adjacent the panel first end. The keyway spline is between first and second generally vertical walls that are either generally perpendicular to the panel faces or that comprise one of the panel faces. The keyway spline includes a generally planar distal face, a first offset face, and a second offset face. The distal face extends generally vertically and has opposed first and second ends. The first offset face extends from the distal face first end to the first wall, and the second offset face extends from the distal face second end to the second wall. The first offset face is generally vertical and is angled relative to the distal face more than ninety degrees and less than one hundred and eighty degrees; the second offset face is generally vertical and is angled relative to the distal face more than ninety degrees and less than one hundred and eighty degrees. The angle between the second offset face and the distal face is at least twenty five percent greater than the angle between the first offset face and the distal face. The second wall is outset toward the distal face from the first wall.

A modular construction system according to an embodiment includes first and second panels, each having: a height; opposed first and second faces; opposed generally vertical first and second ends; a keyway receiver at either the panel first end or one of the panel faces adjacent the panel first end; and a keyway spline at either the panel second end or one of the panel faces adjacent the panel second end. The keyway receiver of each panel is between first and second generally vertical walls that are either generally perpendicular to the panel faces or that comprise one of the panel faces. The keyway spline of each panel is between third and fourth generally vertical walls that are either generally perpendicular to the panel faces or that comprise one of the panel faces. At least one of the third and fourth walls is separate from at least one of the first and second walls. The keyway receiver of each panel includes: a generally planar proximal face extending generally vertically and having opposed first and second ends; a first offset face extending from the proximal face first end to the first wall, the first offset face being generally vertical and being angled relative to the proximal face to form an opening of more than ninety degrees between the first offset face and the proximal face; and a second offset face extending from the proximal face second end to the second wall, the second offset face being generally vertical and being angled relative to the proximal face to form an opening of more than ninety degrees between the second offset face and the proximal face. The angle of the opening between the second offset face and the proximal face of each panel is at least twenty five percent greater than the angle of the opening between the first offset face and the proximal face of each panel. The second wall of each panel is inset toward the respective proximal face from the respective first wall. The keyway spline of each panel includes: a generally planar distal face extending generally vertically and having opposed first and second ends; a first offset face extending from the distal face first end to the third wall, the first offset face being generally vertical and being angled relative to the distal face more than ninety degrees and less than one hundred and eighty degrees; and a second offset face extending from the distal face second end to the fourth wall, the second offset face being generally vertical and being angled relative to the distal face more than ninety degrees and less than one hundred and eighty degrees. The angle between the second offset face and the distal face of each panel is at least twenty five percent greater than the angle between the first offset face and the distal face of each panel. The fourth wall of each panel is outset toward the respective distal face from the respective third wall. An extended wall section is formed by juxtaposing the proximal face of the first panel and the distal face of the second panel or by juxtaposing the proximal face of the second panel and the distal face of the first panel.

DETAILED DESCRIPTION

Figure 1A:
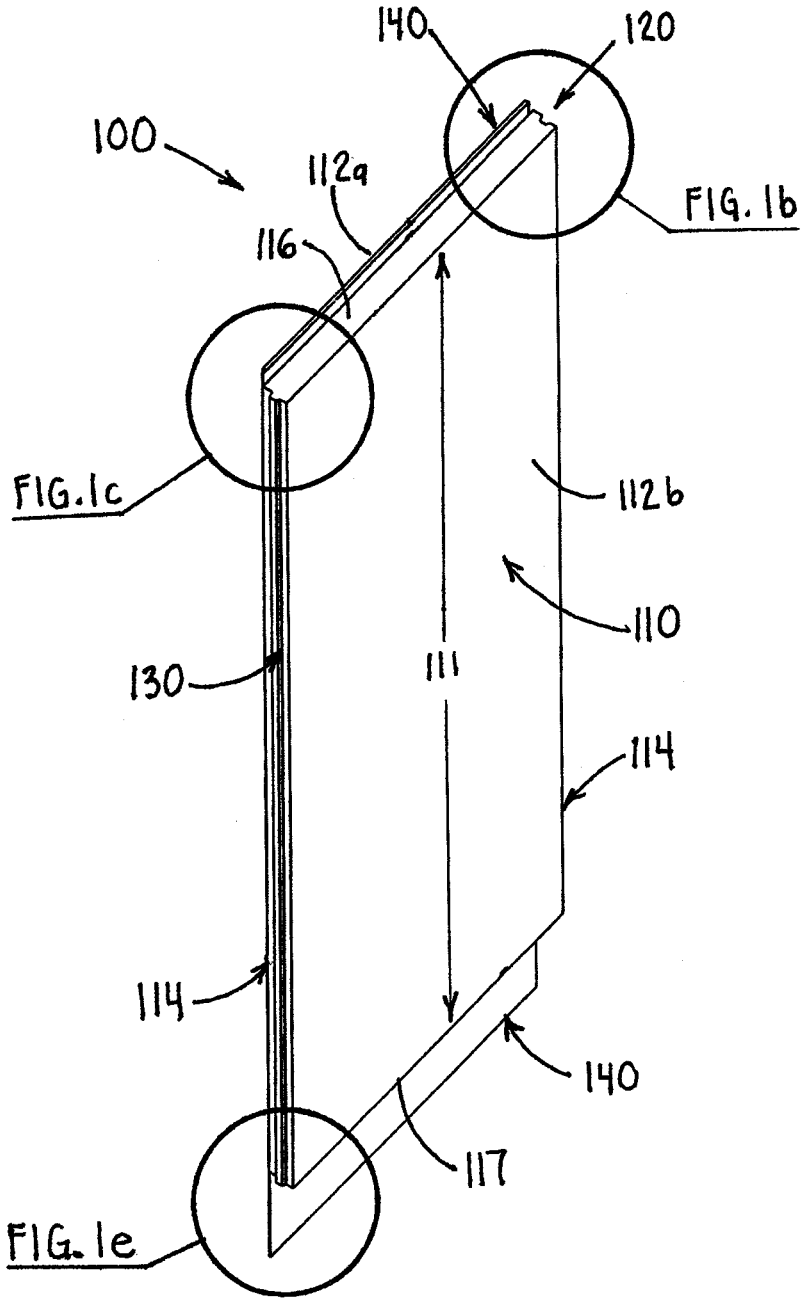
FIG. 1*a* is a perspective view of a modular construction panel according to one embodiment.

As shown in FIGS. 1*a* through 1*e*, a modular construction panel 100 according to one embodiment includes a panel 110 having a height 111, opposed first and second faces 112*a*, 112*b*, and opposed ends 114 that are generally vertical. The height 111 may be generally consistent across the panel 110 and may be defined by a generally horizontal top plate face 116 and a generally horizontal bottom bearing face 117.

The panel 110 may be constructed of various materials, including conventional materials (e.g., wood, steel, concrete, etc.) and non-conventional materials (e.g., plastics, composites, rubbers, etc.) and may have various dimensions. For example, the distance between the faces 112*a*, 112*b* may be selected for structural or insulating properties. The height 111 may be chosen to correspond to a desired ceiling height, as is typical in conventional construction. The distance between the ends 114 may be forty eight inches (or a multiple of 48 inches, such as 96 inches, 144 inches, etc.) to correspond to typical sheets of plywood used for flooring, or may be any other selected distance.

Figure 1B:
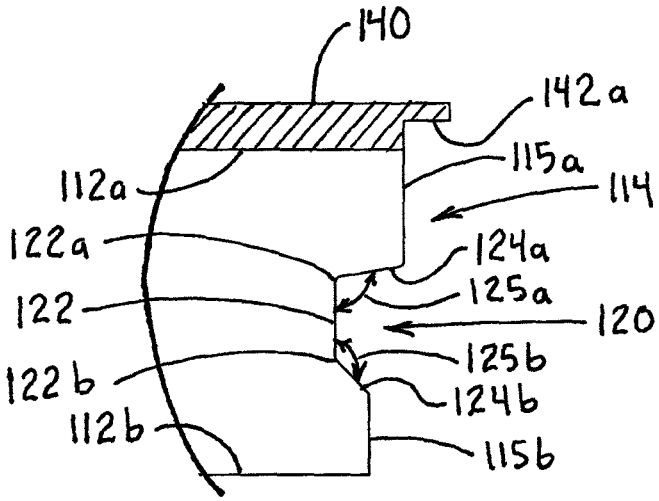
FIG. 1*b* is a partial top view taken from FIG. 1*a*.

A keyway receiver 120 is integral with the panel 110 adjacent one of the ends 114. As shown in FIG. 1*b*, the receiver 120 in the modular construction panel 100 is at one end 114 between generally vertical walls 115*a*, 115*b* that define the end 114. The keyway receiver 120 includes a generally planar proximal face 122 that extends generally vertically and has opposed ends 122*a*, 122*b*. A first offset face 124*a* extends between the end 122*a* of the proximal face 122 and the generally vertical wall 115*a*, and a second offset face 124*b* extends between the end 122*b* of the proximal face 122 and the generally vertical wall 115*b*. The proximal face 122, the wall 115*a*, and the wall 115*b* may be generally parallel to one another, and the wall 115*b* may be inset toward the proximal face 122 from the wall 115*a*. In other words, if respective planes were drawn to include the wall 115*a*, the wall 115*b*, and the proximal face 122, the plane containing the wall 115*b* may be between the other two planes.

The first offset face 124*a* is angled relative to the proximal face 122 to form an opening 125*a* of more than ninety degrees between the first offset face 124*a* and the proximal face 122. The second offset face 124*b* is angled relative to the proximal face 122 to form an opening 125*b* of more than ninety degrees between the second offset face 124*b* and the proximal face 122. The angle of the opening 125*b* between the second offset face 124*b* and the proximal face 122 is at least twenty five percent greater than the angle of the opening 125*a* between the first offset face 124*a* and the proximal face 122, and it may be preferable for the angle of the opening 125*b* to be at least thirty percent greater than the angle of the opening 125*a*. For example, in one embodiment, the angle of the opening 125*a* is approximately 99.46 degrees and the angle of the opening 125*b* is approximately 135 degrees, but it should be understood that other angles may also be used. It should also be appreciated that the first offset face 124*a* may meet the proximal face 122 and/or the wall 115*a* at either a point or a curve, and that the second offset face 124*b* may meet the proximal face 122 and/or the wall 115*b* at either a point or a curve.

Figure 1C:
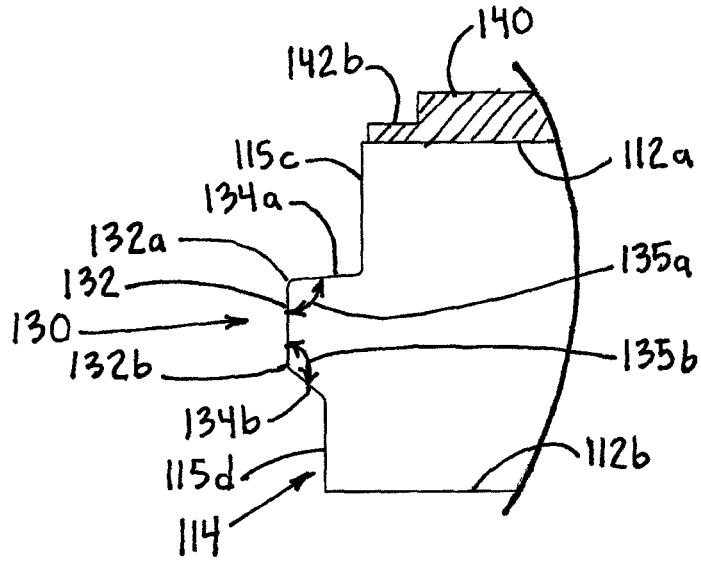
FIG. 1*c* is a partial top view taken from FIG. 1*a*.
Figure 1D:
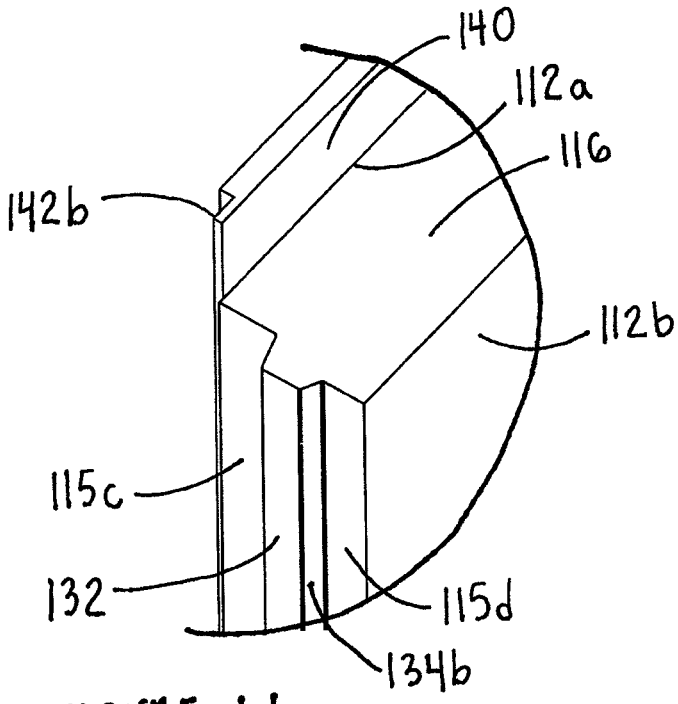
FIG. 1*d* is a perspective view of FIG. 1*c*.
Figure 1E:
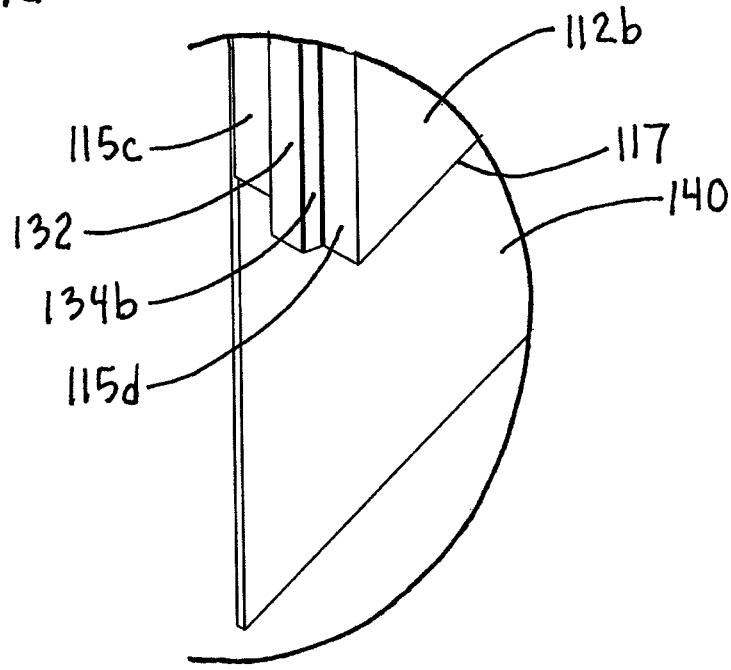
FIG. 1*e* a partial perspective view taken from FIG. 1*a*.

A keyway spline 130 is integral with the panel 110 adjacent the end 114 that is opposite the end 114 adjacent the keyway receiver 120. As shown in FIG. 1*c*, the spline 130 in the modular construction panel 100 is at one end 114 between generally vertical walls 115*c*, 115*d* that define the respective end 114. The keyway spline 130 includes a generally planar distal face 132 that extends generally vertically and has opposed ends 132*a*, 132*b*. A first offset face 134*a* extends between the end 132*a* of the distal face 132 and the generally vertical wall 115*c*, and a second offset face 134*b* extends between the end 132*b* of the distal face 132 and the generally vertical wall 115*d*. The distal face 132, the wall 115*c*, and the wall 115*d* may be generally parallel to one another, and the wall 115*d* may be outset toward the distal face 132 from the wall 115*c*. In other words, if respective planes were drawn to include the wall 115*c*, the wall 115*d*, and the distal face 132, the plane containing the wall 115*d* may be between the other two planes.

The first offset face 134*a* is angled relative to the distal face 132 more than ninety degrees and less than one hundred and eighty degrees. The angle between the first offset face 134*a* and the distal face 132 is denoted in FIG. 1*c* as 135*a*. The second offset face 134*b* is angled relative to the distal face 132 more than ninety degrees and less than one hundred and eighty degrees. The angle between the second offset face 134*b* and the distal face 132 is denoted in FIG. 1*c* as 135*b*. The angle 135*b* between the second offset face 134*b* and the distal face 132 is at least twenty five percent greater than the angle 125*a* between the first offset face 134*a* and the distal face 132, and it may be preferable for the angle 135*b* to be at least thirty percent greater than the angle 135*a*. For example, in one embodiment, the angle 135*a* is approximately 94.76 degrees and the angle 135*b* is approximately 129.81 degrees, but it should be understood that other angles may also be used. It should also be appreciated that the first offset face 134*a* may meet the distal face 132 and/or the wall 115*c* at either a point or a curve, and that the second offset face 134*b* may meet the distal face 132 and/or the wall 115*d* at either a point or a curve.

It may be desirable for the angle 135*a* to be between approximately four degrees and approximately six degrees smaller than the angle of the opening 125*a* between the first offset face 124*a* and the proximal face 122, and for the angle 135*b* to be between approximately four degrees and approximately six degrees smaller than the angle of the opening 125*b* between the second offset face 124*b* and the proximal face 122.

As shown in FIGS. 1*a* through 1*e*, one of the faces 112*a*, 112*b* of the panel 110 (e.g., face 112*a*) may be a finished face, or in other words, may include siding, stucco, masonry, or another appropriate finishing material 140, and may be painted, sealed, or otherwise treated. The finishing material 140 may extend above the top plate face 116 (FIG. 1*d*) and below the bottom bearing face 117 (FIG. 1*e*), and may be at least partially outset or inset from the panel ends 114. For example, as shown in FIGS. 1*b* and 1*c*, the finishing material 140 is partially outset (forming lap joint spline 142*a*) at the end 114 adjacent the keyway receiver 120 and partially inset (forming lap joint receiver 142*b*) at the end 114 adjacent the keyway spline 130. The wall 115*a* may be longer than the wall 115*b*, placing the keyway receiver 120 closer to the interior face (e.g., face 112*b*) of the panel 110 than to the exterior face (e.g., face 112*a*), and the wall 115*c* may be longer than the wall 115*d*, placing the keyway spline 130 closer to the interior face (e.g., face 112*b*) of the panel 110 than to the exterior face (e.g., face 112*a*).

Though not specifically shown in the drawings, it should be understood that the panel 110 may include one or more window, one or more door, insulation, and/or other traditional building components. The panel 110 may be constructed in accordance with building codes to be load bearing, and may be "open-walled", which allows the modular construction panel 100 to be inspected by local building officials and meets national housing lending requirements for buyers to qualify for conventional home loan financing.

Figure 2A:
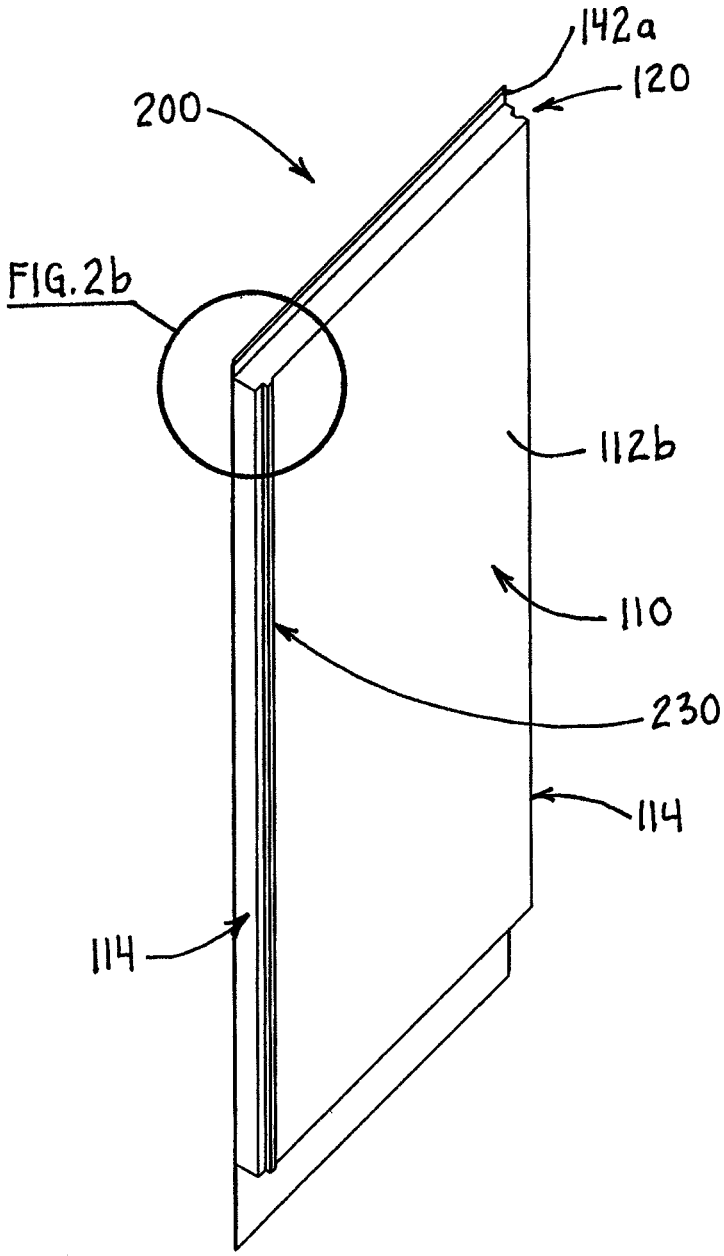
FIG. 2*a* is a perspective view of a modular construction panel according to another embodiment.
Figure 2B:
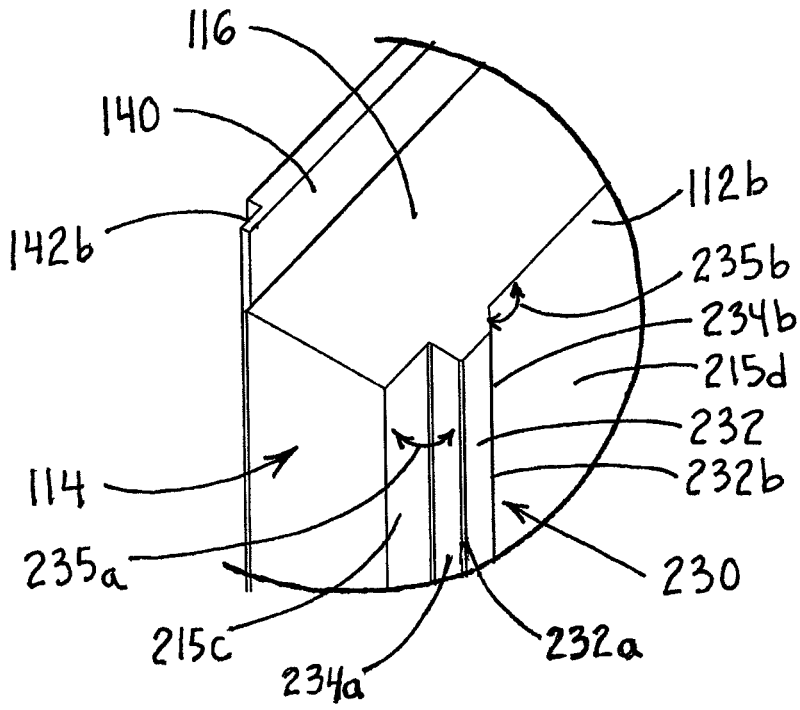
FIG. 2*b* is a partial perspective view taken from FIG. 2*a*.

FIGS. 2*a* and 2*b* show another embodiment of a modular construction panel, denoted by reference number 200. The modular construction panel 200 is generally similar to the modular construction panel 100, except for as set forth herein, shown in the drawings, and/or inherent. Elements of the modular construction panel 200 that are specifically discussed as being different from those of the modular construction panel 100 have reference numbers between 200 and 299.

The modular construction panel 200 includes a keyway spline 230 instead of the keyway spline 130. The keyway spline 230 is integral with the panel 110 adjacent the end 114 that is opposite the end 114 adjacent the keyway receiver 120. As shown in FIG. 2*b*, the keyway spline 230 in the modular construction panel 200 is at one face (e.g., face 112*b*) between generally vertical walls 215*c*, 215*d* that define the face (e.g., face 112*b*). The keyway spline 230 includes a generally planar distal face 232 that extends generally vertically and has opposed ends 232*a*, 232*b*. A first offset face 234*a* extends between the end 232*a* of the distal face 232 and the generally vertical wall 215*c*, and a second offset face 234*b* extends between the end 232*b* of the distal face 232 and the generally vertical wall 215*d*. The distal face 232, the wall 215*c*, and the wall 215*d* may be generally parallel to one another, and the wall 215*d* may be outset toward the distal face 232 from the wall 215*c*. In other words, if respective planes were drawn to include the wall 215*c*, the wall 215*d*, and the distal face 232, the plane containing the wall 215*d* may be between the other two planes.

The first offset face 234*a* is angled relative to the distal face 232 more than ninety degrees and less than one hundred and eighty degrees. The angle between the first offset face 234*a* and the distal face 232 is denoted in FIG. 2*b* as 235*a*. The second offset face 234*b* is angled relative to the distal face 232 more than ninety degrees and less than one hundred and eighty degrees. The angle between the second offset face 234*b* and the distal face 232 is denoted in FIG. 2*b* as 235*b*. The angle 235*b* between the second offset face 234*b* and the distal face 232 is at least twenty five percent greater than the angle 225*a* between the first offset face 234*a* and the distal face 232, and it may be preferable for the angle 235*b* to be at least thirty percent greater than the angle 235*a*. For example, in one embodiment, the angle 235*a* is approximately 94.76 degrees and the angle 235*b* is approximately 129.81 degrees, but it should be understood that other angles may also be used.

It may be desirable for the angle 235*a* to be between approximately four degrees and approximately six degrees smaller than the angle of the opening 125*a* between the first offset face 124*a* and the proximal face 122, and for the angle 235*b* to be between approximately four degrees and approximately six degrees smaller than the angle of the opening 125*b* between the second offset face 124*b* and the proximal face 122.

As in the modular construction panel 100, the finishing material 140 may extend above the top plate face 116 and below the bottom bearing face 117, and may be at least partially outset or inset from the panel ends 114. For example, as shown in FIGS. 2*a* and 2*b*, the finishing material 140 is partially outset (forming lap joint spline 142*a*) at the end 114 adjacent the keyway receiver 120 and partially inset (forming lap joint receiver 142*b*) at the end 114 adjacent the keyway spline 230. The wall 215*d* may be longer than the wall 215*c* so that the keyway spline 230 may interact with a keyway receiver 120 as set forth in additional detail below.

Figure 3A:
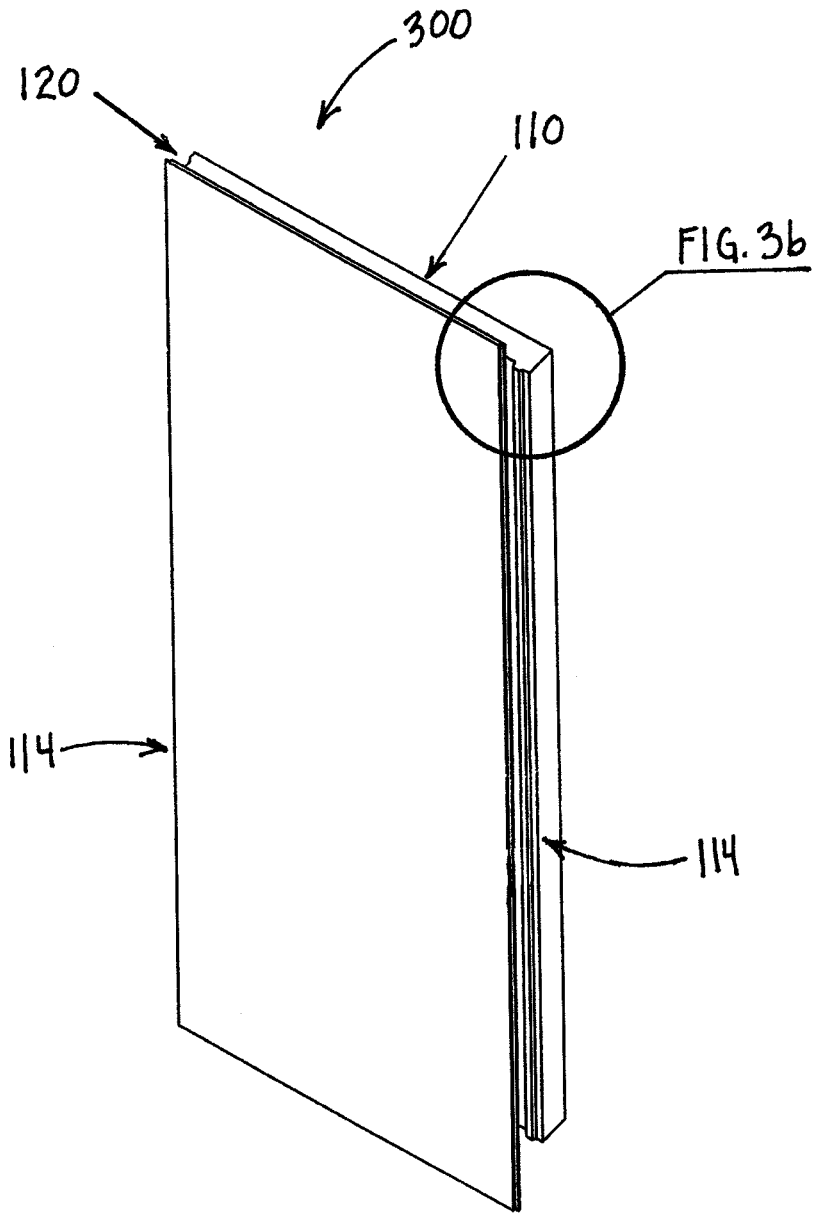
FIG. 3*a* a perspective view of a modular construction panel according to still another embodiment.
Figure 3B:
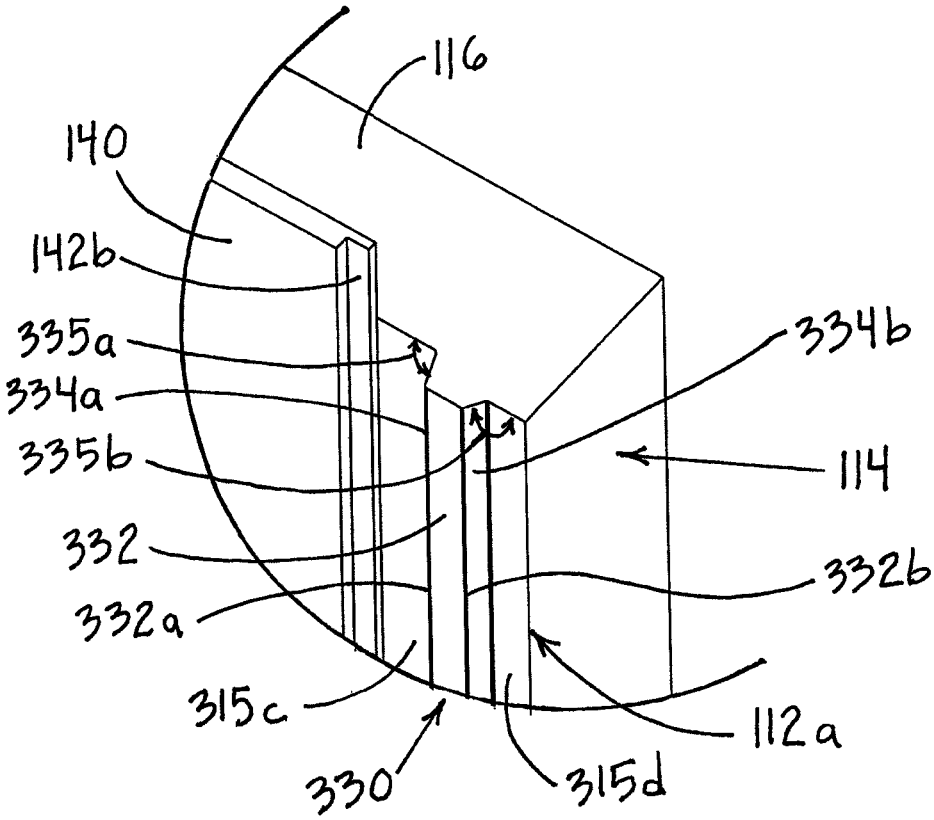
FIG. 3*b* is a partial perspective view taken from FIG. 3*a*.

FIGS. 3*a* and 3*b* show another embodiment of a modular construction panel, denoted by reference number 300. The modular construction panel 300 is generally similar to the modular construction panel 100, except for as set forth herein, shown in the drawings, and/or inherent. Elements of the modular construction panel 300 that are specifically discussed as being different from those of the modular construction panel 100 have reference numbers between 300 and 399.

The modular construction panel 300 includes a keyway spline 330 instead of the keyway spline 130. The keyway spline 330 is integral with the panel 110 adjacent the end 114 that is opposite the end 114 adjacent the keyway receiver 120. As shown in FIG. 3*b*, the keyway spline 330 in the modular construction panel 300 is at one face (e.g., face 112*a*) between generally vertical walls 315*c*, 315*d* that define the face (e.g., face 112*a*). The keyway spline 330 includes a generally planar distal face 332 that extends generally vertically and has opposed ends 332*a*, 332*b*. A first offset face 334*a* extends between the end 332*a* of the distal face 332 and the generally vertical wall 315*c*, and a second offset face 334*b* extends between the end 332*b* of the distal face 332 and the generally vertical wall 315*d*. The distal face 332, the wall 315*c*, and the wall 315*d* may be generally parallel to one another, and the wall 315*d* may be outset toward the distal face 332 from the wall 315*c*. In other words, if respective planes were drawn to include the wall 315*c*, the wall 315*d*, and the distal face 332, the plane containing the wall 315*d* may be between the other two planes.

The first offset face 334*a* is angled relative to the distal face 332 more than ninety degrees and less than one hundred and eighty degrees. The angle between the first offset face 334*a* and the distal face 332 is denoted in FIG. 3*b* as 335*a*. The second offset face 334*b* is angled relative to the distal face 332 more than ninety degrees and less than one hundred and eighty degrees. The angle between the second offset face 334*b* and the distal face 332 is denoted in FIG. 3*b* as 335*b*. The angle 335*b* between the second offset face 334*b* and the distal face 332 is at least twenty five percent greater than the angle 335*a* between the first offset face 334*a* and the distal face 332, and it may be preferable for the angle 335*b* to be at least thirty percent greater than the angle 335*a*. For example, in one embodiment, the angle 335*a* is approximately 94.76 degrees and the angle 335*b* is approximately 129.81 degrees, but it should be understood that other angles may also be used.

It may be desirable for the angle 335*a* to be between approximately four degrees and approximately six degrees smaller than the angle of the opening 125*a* between the first offset face 124*a* and the proximal face 122, and for the angle 335*b* to be between approximately four degrees and approximately six degrees smaller than the angle of the opening 125*b* between the second offset face 124*b* and the proximal face 122.

As in the modular construction panel 100, the finishing material 140 may extend above the top plate face 116 and below the bottom bearing face 117, and may be at least partially outset or inset from the panel ends 114. For example, the finishing material 140 is partially outset (forming a lap joint spline) at the end 114 adjacent the keyway receiver 120 and inset (forming lap joint receiver 142*b*, as shown in FIG. 3*b*) at the end 114 adjacent the keyway spline 330. The wall 315*c* may be longer than the wall 315*d* so that the keyway spline 330 may interact with a keyway receiver 120 as set forth in additional detail below.

Figure 4A:
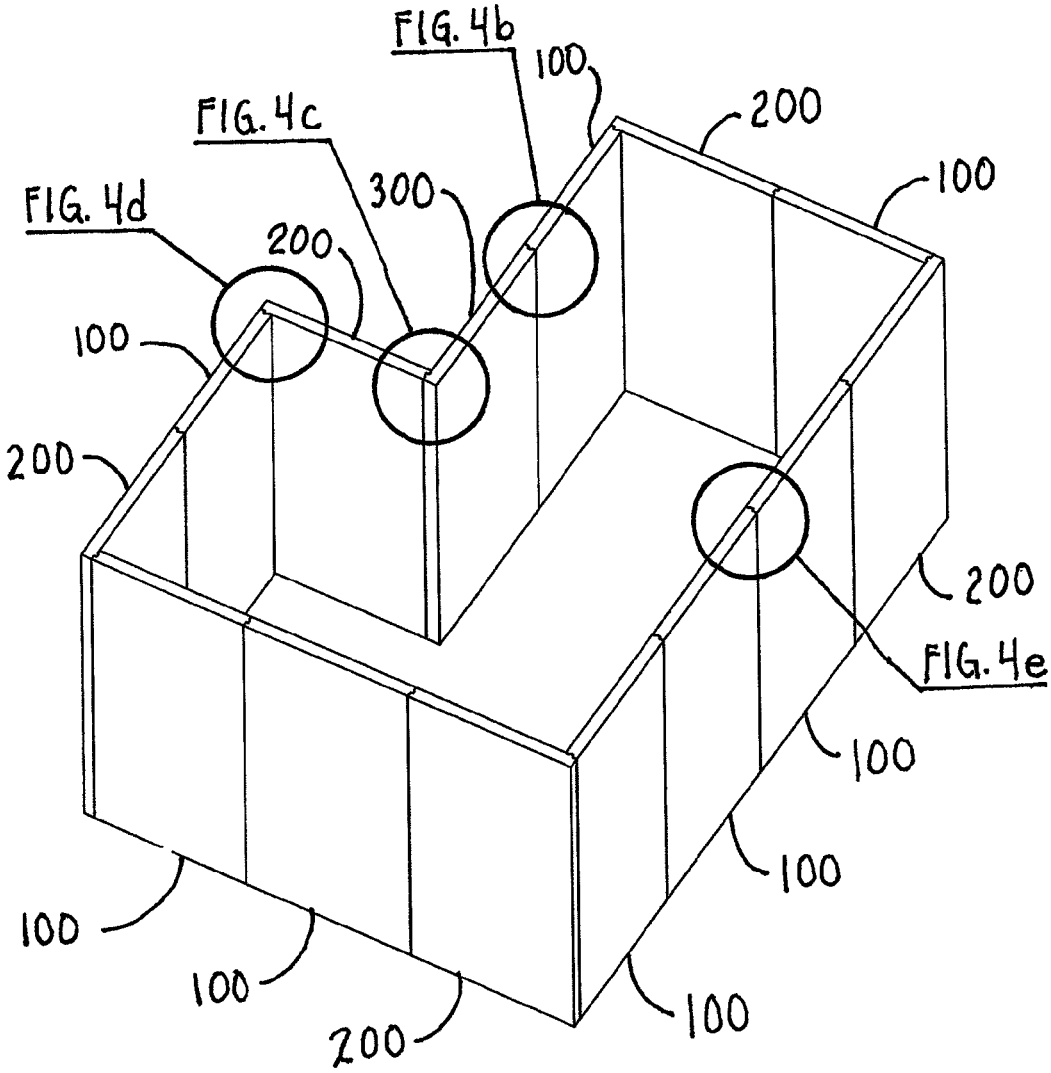
FIG. 4*a* is a perspective view of an extended wall section created using modular construction panels according to an embodiment.
Figure 4B:
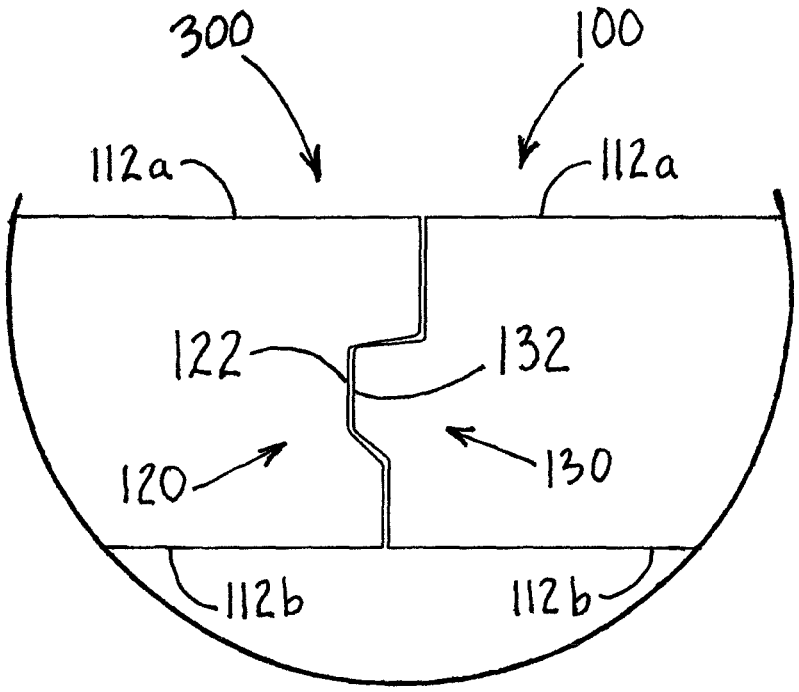
FIG. 4*b* is a top view taken from FIG. 4*a* and rotated.
Figure 4C:
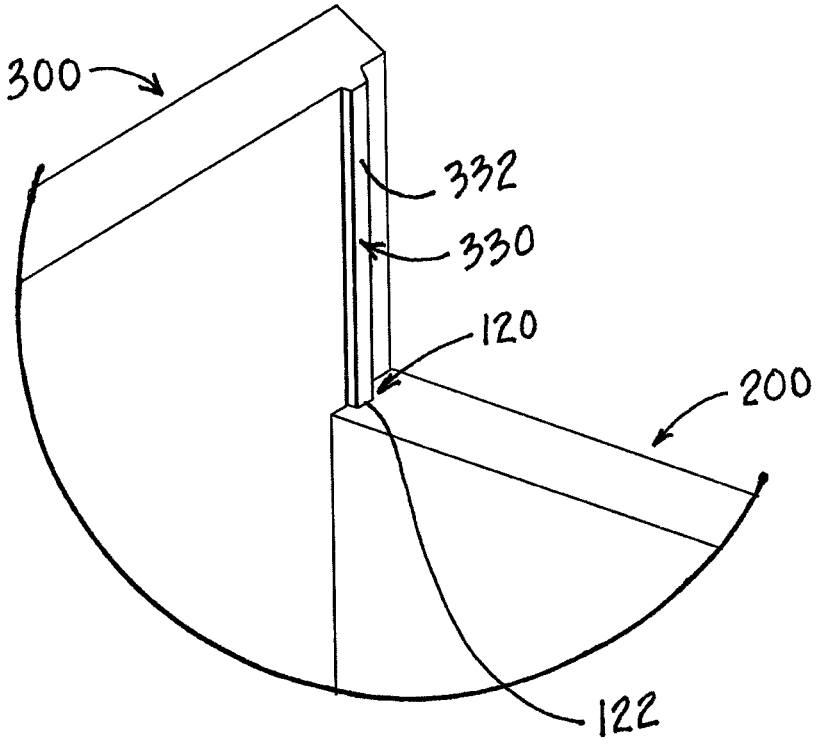
FIG. 4*c* is a partial perspective view taken from FIG. 4*a*, rotated, with a corner of one modular construction panel removed for illustration.
Figure 4D:
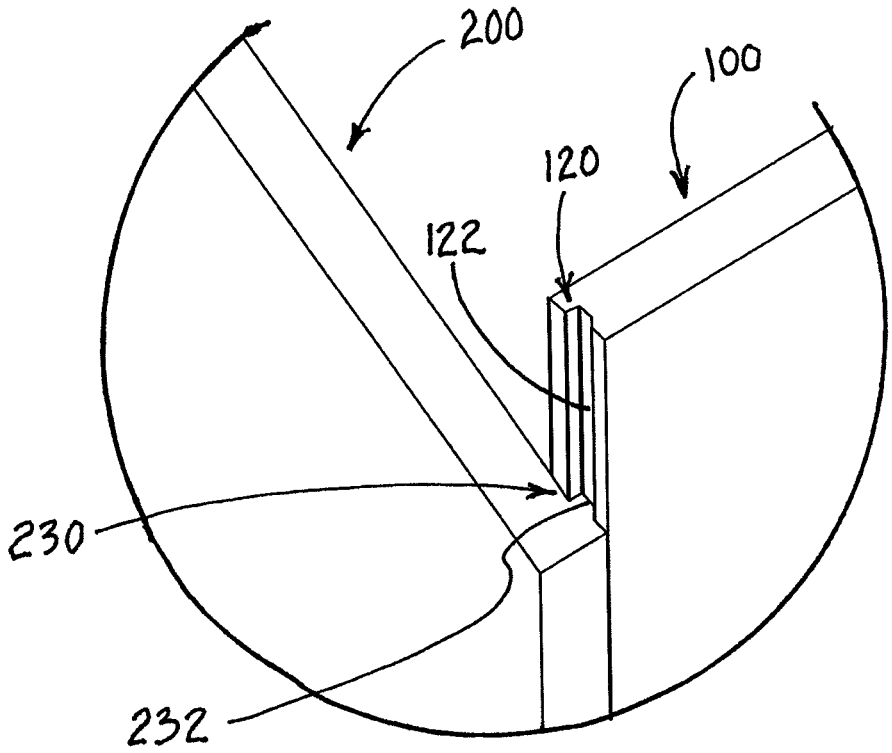
FIG. 4*d* is a partial perspective view taken from FIG. 4*a*, rotated, with a corner of one modular construction panel removed for illustration.
Figure 4E:
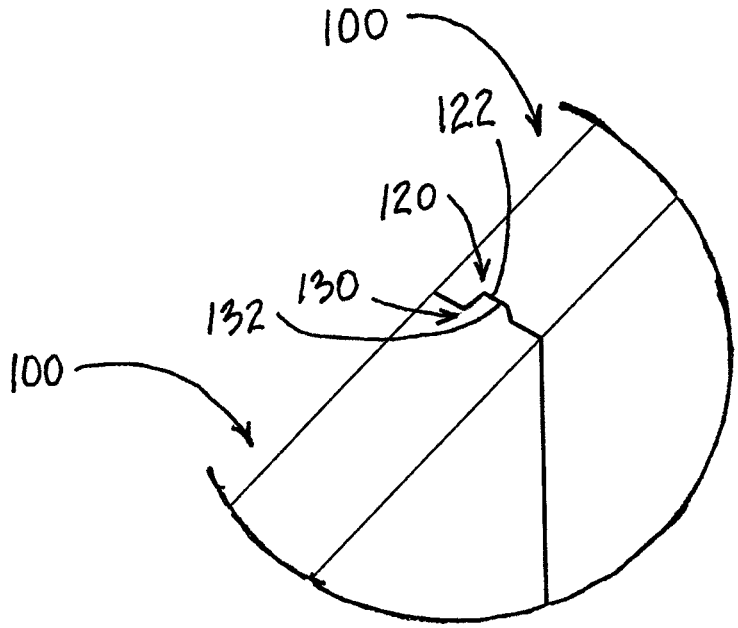
FIG. 4*e* is a partial perspective view taken from FIG. 4*a*.
Figure 5A:
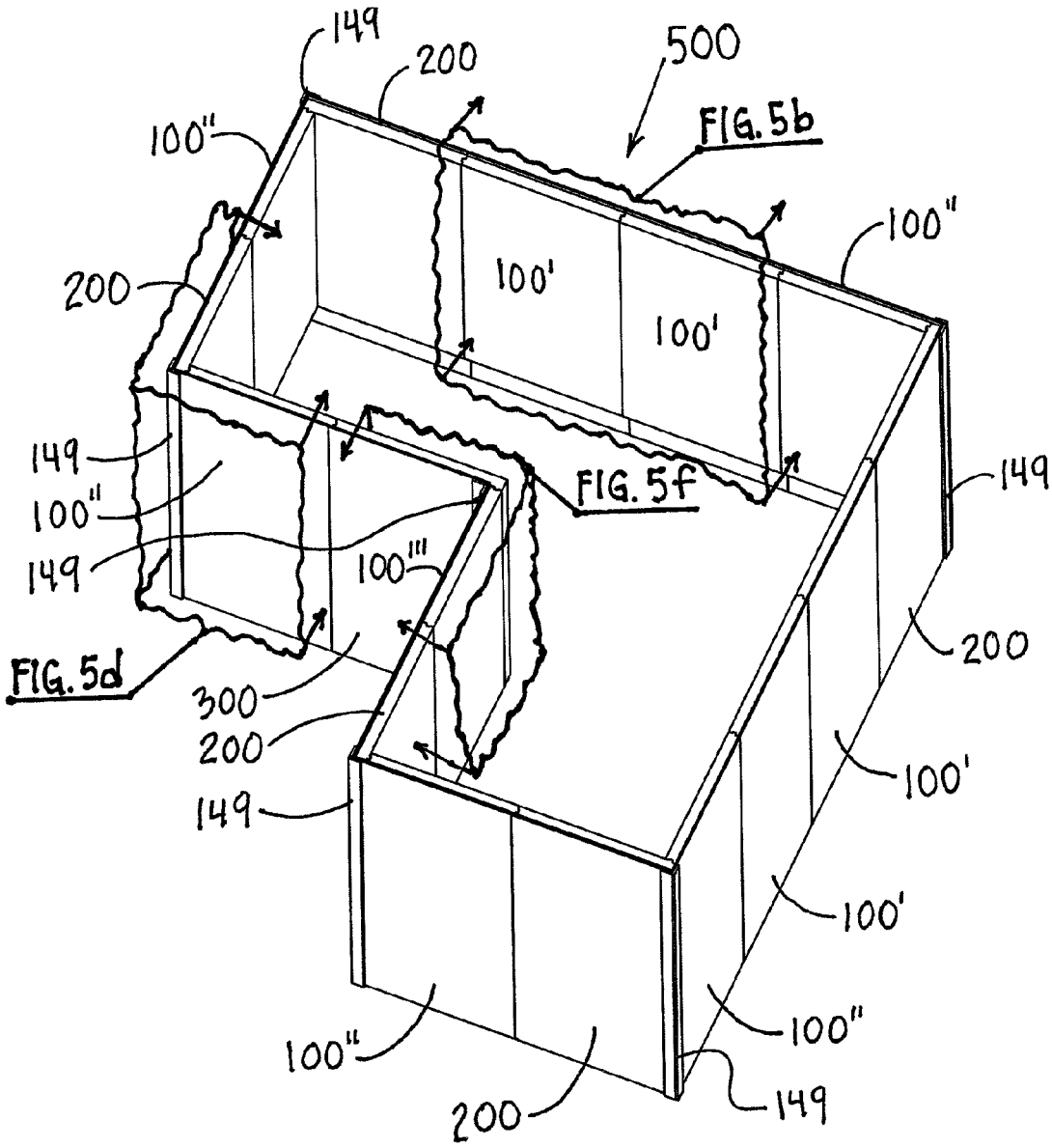
FIG. 5*a* is a perspective view of an extended wall section created using modular construction panels according to another embodiment.
Figure 5B:
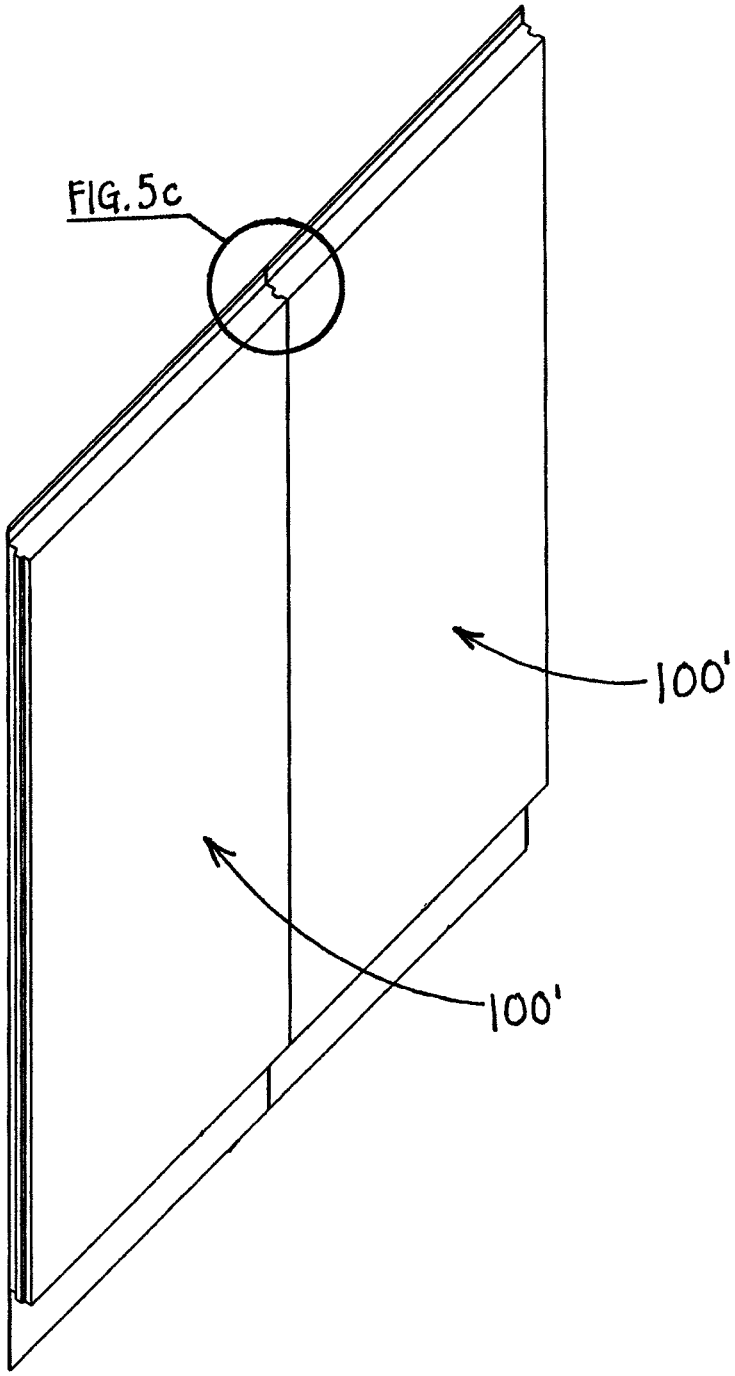
FIG. 5*b* is a partial perspective view of the area generally indicated in FIG. 5*a* and rotated.
Figure 5C:
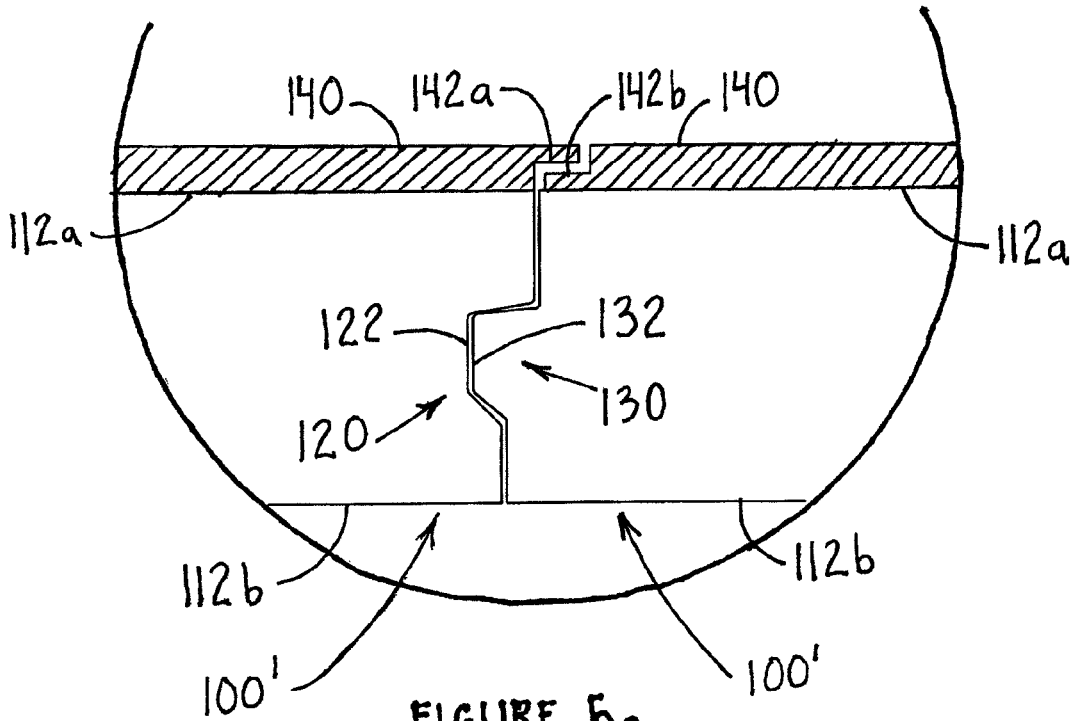
FIG. 5*c* is a top view taken from FIG. 5*b* and rotated.
Figure 5D:
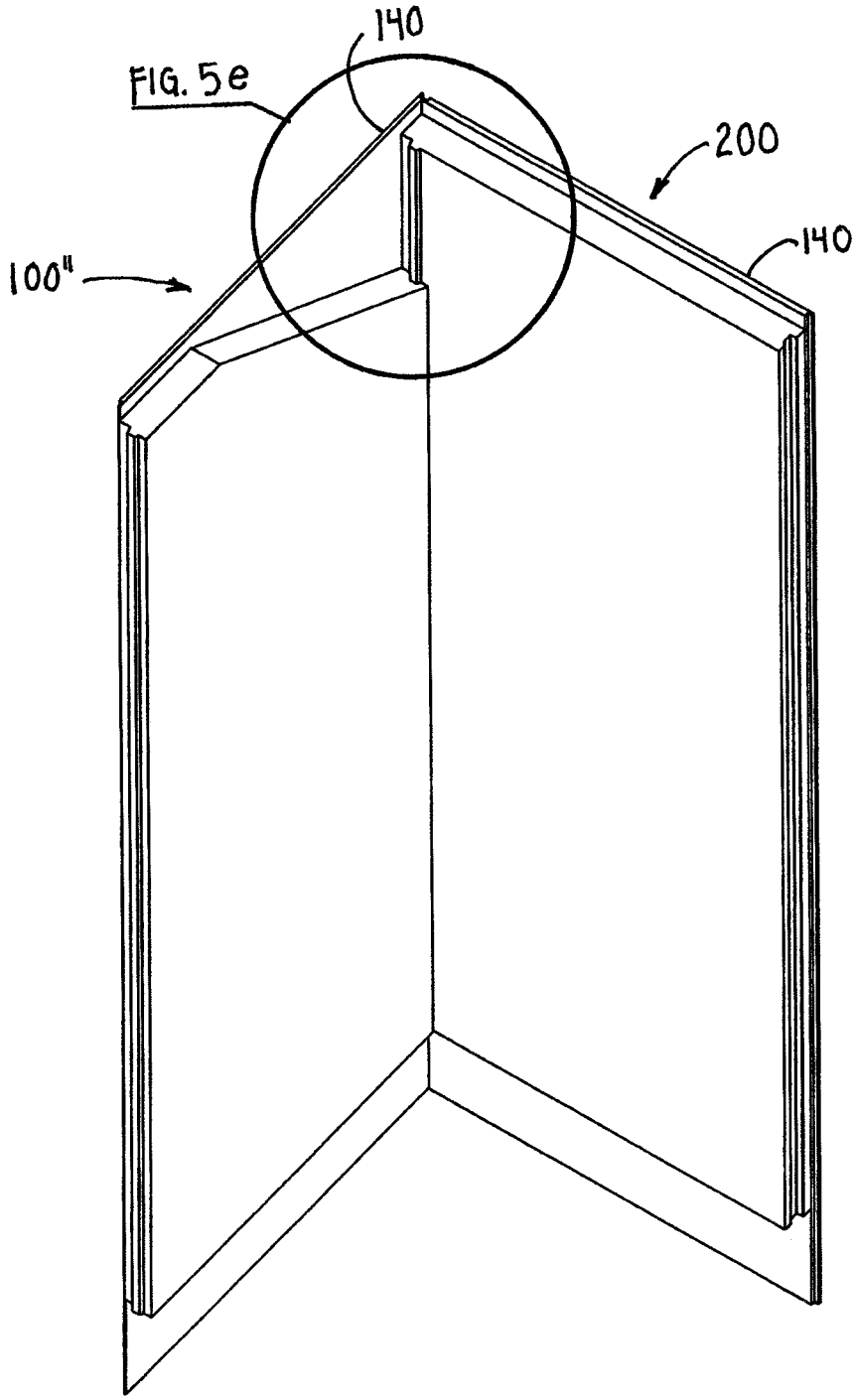
FIG. 5*d* is a partial perspective view of the area generally indicated in FIG. 5*a*, rotated, with a corner of one modular construction panel removed for illustration.
Figure 5E:
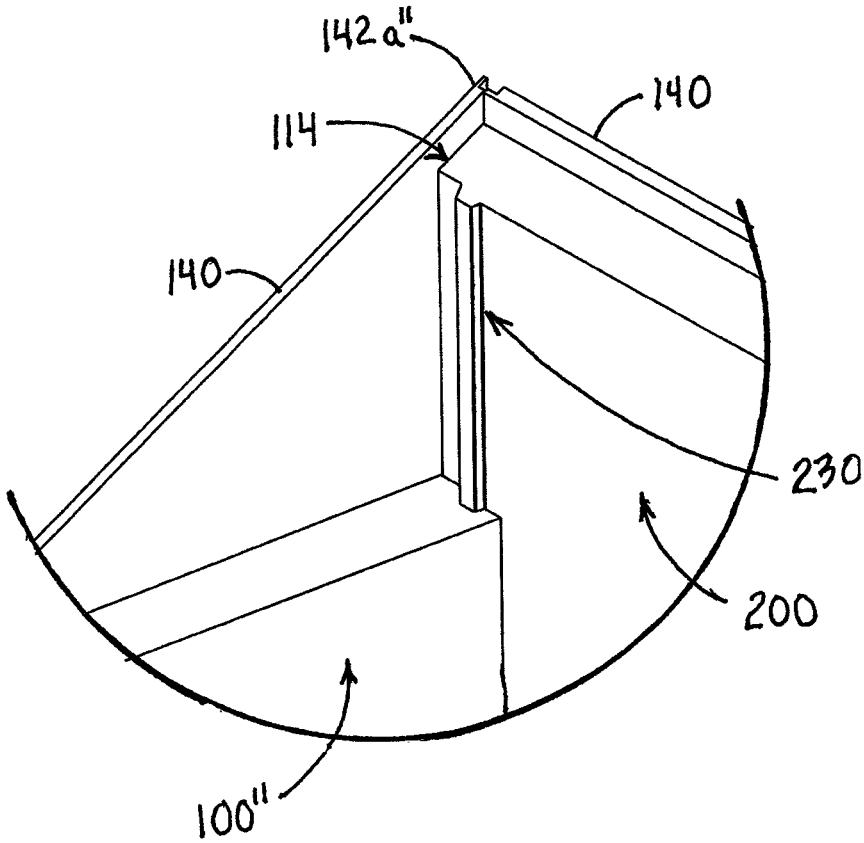
FIG. 5*e* is a partial perspective view taken from FIG. 5*d*.
Figure 5F:
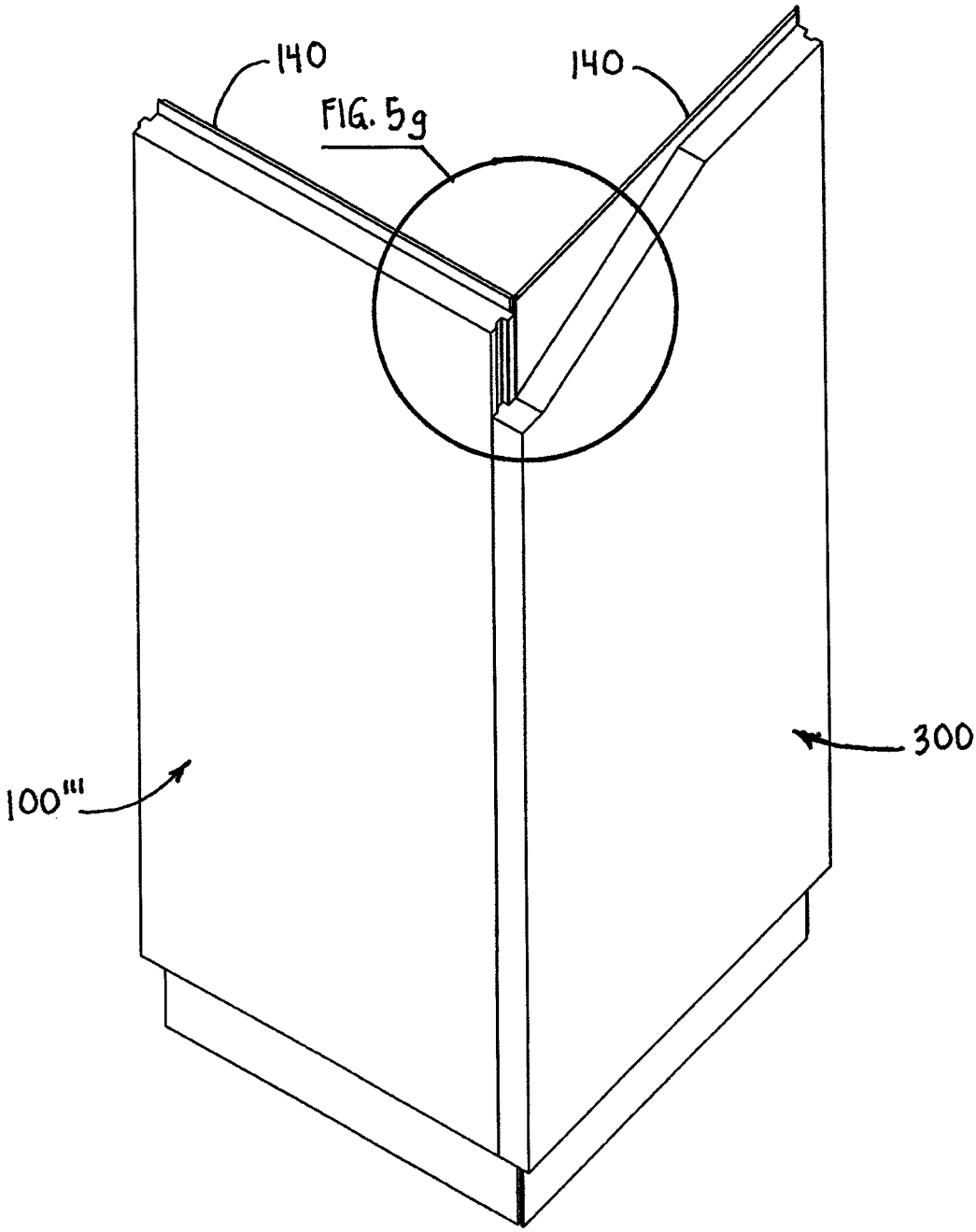
FIG. 5*f* is a partial perspective view of the area generally indicated in FIG. 5*a*, with a corner of one modular construction panel removed for illustration.
Figure 5G:
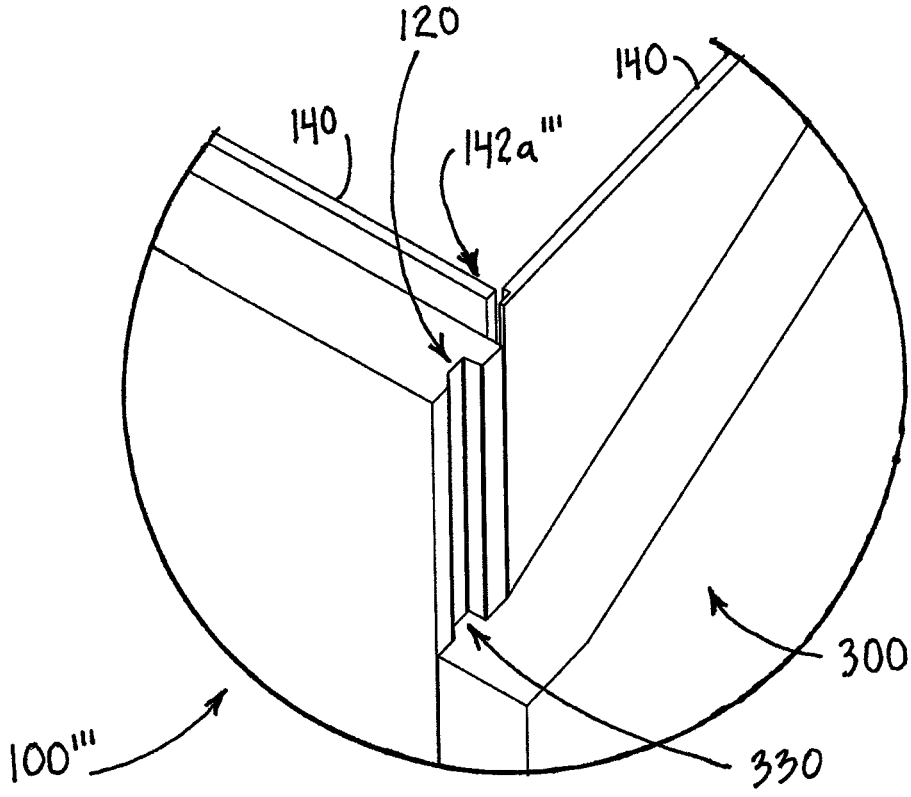
FIG. 5*g* is a partial perspective view taken from FIG. 5*f*.

FIGS. 4*a* through 4*e* show one way that the three modular construction panels 100, 200, 300 may be used to create an extended wall section (e.g., closed perimeter 400) if the modular construction panels 100, 200, 300 do not include a finished face, or in other words, do not include finishing material 140. It should be appreciated that the three modular construction panels 100, 200, 300 may be arranged to form perimeters having various configurations, and that the perimeter 400 is only exemplary. Focusing on FIGS. 4*b* through 4*e*, it can be seen that the keyway receivers 120 and the keyway splines 130, 230, 330 interact to couple adjacent modular construction panels 100, 200, 300 together. More particularly, the distal face 132 of the keyway spline 130 of one modular construction panel 100 is juxtaposed with the proximal face 122 of the keyway receiver 120 of one modular construction panel 300 (FIG. 4*b*); the distal face 332 of the keyway spline 330 of the modular construction panel 300 is juxtaposed with the proximal face 122 of the keyway receiver 120 of one modular construction panel 200 (FIG. 4*c*); the distal face 232 of the keyway spline 230 of the modular construction panel 200 is juxtaposed with the proximal face 122 of the keyway receiver 120 of another modular construction panel 100 (FIG. 4*d*); and the distal face 132 of the keyway spline 130 of one modular construction panel 100 is juxtaposed with the proximal face 122 of the keyway receiver 120 of another modular construction panel 100 (FIG. 4*e*). The configurations of the keyway receivers 120 and the keyway splines 130, 230, 330 may allow a respective panel 110 to be rotated into place relative to an adjacent stationary panel 110. Top plates are coupled (e.g., nailed or screwed) to the top plate faces 116 to further secure the modular construction panels 100, 200, 300 to one another.

It should be clear that any number and combination of modular construction panels 100, 200, 300 may be transported to the construction site and joined in this manner if finishing material 140 is not included, and that only the three types of standard modular construction panels 100, 200, 300 are required. Once the perimeter 400 is formed, the building may be constructed traditionally. In other words, a roof or second floor may be supported by the modular construction panels 100, 200, 300; exterior sides of the modular construction panels 100, 200, 300 may be finished with an exterior material; plumbing, air ducts, electricity, and insulation may be placed inside the modular construction panels 100, 200, 300; interior sides of the modular construction panels 100, 200, 300 may be finished with drywall or another interior material; etc. If a second floor is added, it may have a perimeter comprised of additional modular construction panels 100, 200, 300. To maintain standard construction dimensions, it may be desirable to include additional panels of different lengths; for example, panels 100 that interact with splines 230 may be shorter than other panels 100.

FIGS. 5*a* through 5*g* show another way that the modular construction panels 100, 200, 300 may be used to create an extended wall section (e.g., closed perimeter 500) if the modular construction panels 100, 200, 300 each includes a finished face (i.e., finishing material 140). It should be appreciated that the modular construction panels 100, 200, 300 may be arranged to form perimeters having various configurations, and that the perimeter 500 is only exemplary.

If each modular construction panel 100, 200, 300 includes a single finished face, then three distinct configurations of the modular construction panel 100 are required in a basic embodiment, resulting in five distinct modular construction panels. More specifically, a first configuration 100' (FIGS. 5*b* and 5*c*) of the modular construction panel 100 has finishing material 140 that is partially outset (forming lap joint spline 142*a*) at the end 114 adjacent the keyway receiver 120 for interacting with a lap joint receiver 142*b*; a second configuration 100" (FIGS. 5*d* and 5*e*) of the modular construction panel 100 has finishing material 140 that is entirely offset (forming extension 142*a*") for covering an end 114 of the modular construction panel 200; and a third configuration 100''' (FIGS. 5*f* and 5*g*) of the modular construction panel 100 has finishing material 140 that is at least partially inset (forming lap joint receiver 142*a*''') for mating with finishing material 140 of the modular construction panel 300. Each of the configurations 100', 100", 100''' of the modular construction panel 100 may have finishing material 140 that is partially inset (forming lap joint receiver 142*b*) at the end 114 adjacent the keyway spline 130 (FIG. 1*c*).

As such, in the basic pre-finished embodiment, configuration 100" of the modular construction panel 100 must be used only with the modular construction panel 200 to form an outside corner (i.e., though interaction between keyway receiver 120 and keyway spline 230, as set forth above), and configuration 100''' of the modular construction panel 100 must be used only with the modular construction panel 300 to form an inside corner (i.e., through interaction between keyway receiver 120 and keyway spline 330, as set forth above). Configuration 100' of the modular construction panel 100 may be used with any of the modular construction panels 100 (i.e., configuration 100', configuration 100", or configuration 100''') to form an extended wall section that is straight (i.e., through interaction between keyway receiver 120 and keyway spline 130. Especially at the corners (i.e., where a modular construction panel 100 meets a modular construction panel 200 to form an outside corner and where a modular construction panel 100 meets a modular construction panel 300 to form an inside corner), trim, caulk, or another finishing material may cover a portion of the finish material 140. Exemplary trim 149 is shown only in FIG. 5*a*.

It should be appreciated that in a more complex pre-finished embodiment, additional configurations of the modular construction panels 200, 300 may be included that are similar to configurations 100", 100''' so that modular construction panels 200, 300 may be coupled to one another. It should also be understood that other embodiments may include finishing material 140 on more than one side of a respective panel 110, and that the finishing material 140 on other panels 110 may need to be altered as a result.

Those skilled in the art appreciate that variations from the specified embodiments disclosed above are contemplated herein and that the described embodiments are not limiting. The description should not be restricted to the above embodiments, but should be measured by the following claims.

I claim:

1. A modular construction panel, comprising:

a panel having a height, opposed first and second faces, and opposed ends, each end being generally vertical;

a keyway receiver integral with the panel adjacent one of the panel ends; and a keyway spline integral with the panel adjacent another of the panel ends;

wherein the keyway receiver includes:

a generally planar proximal face extending generally vertically and having opposed ends;

a first offset face extending from one of the proximal face ends, the first offset face being generally vertical and being angled relative to the proximal face to form an opening of more than ninety degrees between the first offset face and the proximal face; and a second offset face extending from another of the proximal face ends, the second offset face being generally vertical and being angled relative to the proximal face to form an opening of more than ninety degrees between the second offset face and the proximal face, the angle of the opening between the second offset face and the proximal face being at least thirty percent greater than the angle of the opening between the first offset face and the proximal face;

wherein a generally vertical wall extends from the keyway receiver first offset face and another generally vertical wall extends from the keyway receiver second offset face; the wall extending from the keyway receiver first offset face, the wall extending from the keyway receiver second offset face, and the proximal face being generally parallel; the wall extending from the keyway receiver second offset face being inset toward the proximal face from the wall extending from the keyway receiver first offset face;

wherein the keyway spline includes:

a generally planar distal face extending generally vertically and having opposed ends;

a first offset face extending from one of the distal face ends, the first offset face being generally vertical and being angled relative to the distal face more than ninety degrees and less than one hundred and eighty degrees; and a second offset face extending from another of the distal face ends, the second offset face being generally vertical and being angled relative to the distal face more than ninety degrees and less than one hundred and eighty degrees, the angle between the second offset face and the distal face being at least thirty percent greater than the angle between the first offset face and the distal face; and wherein a generally vertical wall extends from the keyway spline first offset face and another generally vertical wall extends from the keyway spline second offset face; the wall extending from the keyway spline first offset face, the wall extending from the keyway spline second offset face, and the distal face being generally parallel; the wall extending from the keyway spline second offset face being outset toward the distal face from the wall extending from the keyway spline first offset face.

2. The modular construction panel of claim 1, wherein:

the opening formed between the proximal face and the first offset face of the keyway receiver is between about four degrees and about six degrees larger than the angle between the distal face and the first offset face of the keyway spline; and the opening formed between the proximal face and the second offset face of the keyway receiver is between about four degrees and about six degrees larger than the angle between the distal face and the second offset face of the keyway spline.

3. The modular construction panel of claim 2, wherein:

the opening formed between the proximal face and the first offset face of the keyway receiver is about 99.5 degrees; and the opening formed between the proximal face and the second offset face of the keyway receiver is about 135 degrees.

4. The modular construction panel of claim 1, wherein:

one of the panel ends includes the keyway receiver, the wall extending from the keyway receiver first offset face, and the wall extending from the keyway receiver second offset face; and another of the panel ends includes the keyway spline, the wall extending from the keyway spline first offset face, and the wall extending from the keyway spline second offset face.

5. The modular construction panel of claim 1, wherein one of the panel faces includes the keyway receiver, the wall extending from the keyway receiver first offset face, and the wall extending from the keyway receiver second offset face.

6. The modular construction panel of claim 1, wherein one of the panel faces includes the keyway spline, the wall extending from the keyway spline first offset face, and the wall extending from the keyway spline second offset face.

7. The modular construction panel of claim 1, wherein the wall extending from the keyway receiver first offset face is longer than the wall extending from the keyway receiver second offset face.

8. The modular construction panel of claim 1, wherein the first panel face is a finished exterior face.

9. The modular construction panel of claim 8, wherein:

the panel height is generally consistent and is defined by a generally horizontal top plate face and a generally horizontal bottom bearing face;

the finished exterior face extends above the top plate face;

the finished exterior face extends below the bottom bearing face; and the finished exterior face is at least one of:

partially outset from the keyway receiver to form a lap joint spline; and partially inset from the keyway spline to form a lap joint receiver.

10. The modular construction panel of claim 1, wherein the panel height is generally consistent and is defined by a generally horizontal top plate face and a generally horizontal bottom bearing face.

11. The modular construction panel of claim 1, wherein:

the panel is constructed of at least one of wood, metal, or concrete; and the distance between the opposed panel ends is about "x" multiplied by forty eight inches, "x" being a whole positive integer.

12. A modular construction panel, comprising:

a panel having a height, opposed first and second faces, and opposed first and second generally vertical ends; and a keyway receiver integral with the panel at either the panel first end or one of the panel faces adjacent the panel first end;

wherein the keyway receiver is between first and second generally vertical walls that are either generally perpendicular to the panel faces or that comprise one of the panel faces;

wherein the keyway receiver includes:

a generally planar proximal face extending generally vertically and having opposed first and second ends;

a first offset face extending from the proximal face first end to the first wall, the first offset face being generally vertical and being angled relative to the proximal face to form an opening of more than ninety degrees between the first offset face and the proximal face; and a second offset face extending from the proximal face second end to the second wall, the second offset face being generally vertical and being angled relative to the proximal face to form an opening of more than ninety degrees between the second offset face and the proximal face, the angle of the opening between the second offset face and the proximal face being at least twenty five percent greater than the angle of the opening between the first offset face and the proximal face; and wherein the second wall is inset toward the proximal face from the first wall.

13. The modular construction panel of claim 12, wherein the first wall is longer than the second wall.

14. The modular construction panel of claim 12, further comprising a keyway spline integral with the panel at either the panel second end or one of the panel faces adjacent the panel second end.

15. The modular construction panel of claim 12, wherein:

the first panel face is a finished exterior face;

the panel height is generally consistent and is defined by a generally horizontal top plate face and a generally horizontal bottom bearing face;

the finished exterior face extends above the top plate face; and the finished exterior face extends below the bottom bearing face.

16. The modular construction panel of claim 15, wherein:

the finished exterior face is at least one of partially outset or inset from the panel first end; and the finished exterior face is at least one of partially outset or inset from the panel second end.

17. A modular construction panel, comprising:

a panel having a height, opposed first and second faces, and opposed first and second generally vertical ends; and a keyway spline integral with the panel at either the panel first end or one of the panel faces adjacent the panel first end;

wherein the keyway spline is between first and second generally vertical walls that are either generally perpendicular to the panel faces or that comprise one of the panel faces;

wherein the keyway spline includes:

a generally planar distal face extending generally vertically and having opposed first and second ends;

a first offset face extending from the distal face first end to the first wall, the first offset face being generally vertical and being angled relative to the distal face more than ninety degrees and less than one hundred and eighty degrees;

a second offset face extending from the distal face second end to the second wall, the second offset face being generally vertical and being angled relative to the distal face more than ninety degrees and less than one hundred and eighty degrees, the angle between the second offset face and the distal face being at least twenty five percent greater than the angle between the first offset face and the distal face; and wherein the second wall is outset toward the distal face from the first wall.

18. The modular construction panel of claim 17, further comprising a keyway receiver integral with the panel at either the panel second end or one of the panel faces adjacent the panel second end.

19. The modular construction panel of claim 17, wherein:

the first panel face is a finished exterior face;

the panel height is generally consistent and is defined by a generally horizontal top plate face and a generally horizontal bottom bearing face;

the finished exterior face extends above the top plate face;

the finished exterior face extends below the bottom bearing face;

the finished exterior face is at least one of partially outset or inset from the panel first end; and the finished exterior face is at least one of partially outset or inset from the panel second end.

20. A modular construction system, comprising:

a first panel having:

a height, opposed first and second faces, and opposed generally vertical first and second ends;

a keyway receiver at either the panel first end or one of the panel faces adjacent the panel first end;

a keyway spline at either the panel second end or one of the panel faces adjacent the panel second end;

wherein the keyway receiver is between first and second generally vertical walls that are either generally perpendicular to the panel faces or that comprise one of the panel faces;

wherein the keyway spline is between third and fourth generally vertical walls that are either generally perpendicular to the panel faces or that comprise one of the panel faces, at least one of the third and fourth walls being separate from at least one of the first and second walls;

wherein the keyway receiver includes:

a generally planar proximal face extending generally vertically and having opposed first and second ends;

a first offset face extending from the proximal face first end to the first wall, the first offset face being generally vertical and being angled relative to the proximal face to form an opening of more than ninety degrees between the first offset face and the proximal face;

a second offset face extending from the proximal face second end to the second wall, the second offset face being generally vertical and being angled relative to the proximal face to form an opening of more than ninety degrees between the second offset face and the proximal face, the angle of the opening between the second offset face and the proximal face being at least twenty five percent greater than the angle of the opening between the first offset face and the proximal face;

wherein the second wall is inset toward the proximal face from the first wall;

wherein the keyway spline includes:

a generally planar distal face extending generally vertically and having opposed first and second ends;

a first offset face extending from the distal face first end to the third wall, the first offset face being generally vertical and being angled relative to the distal face more than ninety degrees and less than one hundred and eighty degrees;

a second offset face extending from the distal face second end to the fourth wall, the second offset face being generally vertical and being angled relative to the distal face more than ninety degrees and less than one hundred and eighty degrees, the angle between the second offset face and the distal face being at least twenty five percent greater than the angle between the first offset face and the distal face;

wherein the fourth wall is outset toward the distal face from the third wall;

a second panel having:

a height, opposed first and second faces, and opposed generally vertical first and second ends;

a keyway receiver at either the panel first end or one of the panel faces adjacent the panel first end;

a keyway spline at either the panel second end or one of the panel faces adjacent the panel second end;

wherein the keyway receiver is between first and second generally vertical walls that are either generally perpendicular to the panel faces or that comprise one of the panel faces;

wherein the keyway spline is between third and fourth generally vertical walls that are either generally perpendicular to the panel faces or that comprise one of the panel faces, at least one of the third and fourth walls being separate from at least one of the first and second walls;

wherein the keyway receiver includes:

a generally planar proximal face extending generally vertically and having opposed first and second ends;

a first offset face extending from the proximal face first end to the first wall, the first offset face being generally vertical and being angled relative to the proximal face to form an opening of more than ninety degrees between the first offset face and the proximal face;

a second offset face extending from the proximal face second end to the second wall, the second offset face being generally vertical and being angled relative to the proximal face to form an opening of more than ninety degrees between the second offset face and the proximal face, the angle of the opening between the second offset face and the proximal face being at least twenty five percent greater than the angle of the opening between the first offset face and the proximal face;

wherein the second wall is inset toward the proximal face from the first wall;

wherein the keyway spline includes:

a generally planar distal face extending generally vertically and having opposed first and second ends;

a first offset face extending from the distal face first end to the third wall, the first offset face being generally vertical and being angled relative to the distal face more than ninety degrees and less than one hundred and eighty degrees;

a second offset face extending from the distal face second end to the fourth wall, the second offset face being generally vertical and being angled relative to the distal face more than ninety degrees and less than one hundred and eighty degrees, the angle between the second offset face and the distal face being at least twenty five percent greater than the angle between the first offset face and the distal face;

wherein the fourth wall is outset toward the distal face from the third wall;

wherein an extended wall section is formed by juxtaposing the proximal face of the first panel and the distal face of the second panel or by juxtaposing the proximal face of the second panel and the distal face of the first panel.

21. The system of claim 20, wherein:

the height of the first panel is generally consistent and is defined by a generally horizontal top plate face and a generally horizontal bottom bearing face;

the height of the second panel is generally consistent and is defined by a generally horizontal top plate face and a generally horizontal bottom bearing face;

the height of the first panel is generally equal to the height of the second panel; and a top plate is positioned to extend upwardly adjacent the top plate face of the first panel and the top plate face of the second panel and is coupled to the first and second panels.

22. The system of claim 21, wherein:

the extended wall section is formed by juxtaposing the proximal face of the first panel and the distal face of the second panel;

juxtaposing the proximal and distal faces to form the extended wall section creates a vertical joint;

creating the vertical joint does not require a tool and does not require any component separate from the keyway receiver of the first panel and the keyway spline of the second panel.

23. A modular construction panel, comprising:

a panel having a height, opposed first and second faces, and opposed ends, each end being generally vertical;

a keyway receiver integral with the panel adjacent one of the panel ends; and a keyway spline integral with the panel adjacent another of the panel ends;

wherein the keyway receiver includes:

a generally planar proximal face extending generally vertically and having opposed ends;

a first offset face extending from one of the proximal face ends, the first offset face being generally vertical and being angled relative to the proximal face to form an opening of more than ninety degrees between the first offset face and the proximal face; and a second offset face extending from another of the proximal face ends, the second offset face being generally vertical and being angled relative to the proximal face to form an opening of more than ninety degrees between the second offset face and the proximal face, the angle of the opening between the second offset face and the proximal face being at least thirty percent greater than the angle of the opening between the first offset face and the proximal face;

wherein a generally vertical wall extends from the keyway receiver first offset face and another generally vertical wall extends from the keyway receiver second offset face; the wall extending from the keyway receiver first offset face, the wall extending from the keyway receiver second offset face, and the proximal face being generally parallel; the wall extending from the keyway receiver second offset face being inset toward the proximal face from the wall extending from the keyway receiver first offset face;

wherein the keyway spline includes:

a generally planar distal face extending generally vertically and having opposed ends;

a first offset face extending from one of the distal face ends, the first offset face being generally vertical and being angled relative to the distal face more than ninety degrees and less than one hundred and eighty degrees; and a second offset face extending from another of the distal face ends, the second offset face being generally vertical and being angled relative to the distal face more than ninety degrees and less than one hundred and eighty degrees, the angle between the second offset face and the distal face being at least thirty percent greater than the angle between the first offset face and the distal face;

wherein a generally vertical wall extends from the keyway spline first offset face and another generally vertical wall extends from the keyway spline second offset face; the wall extending from the keyway spline first offset face, the wall extending from the keyway spline second offset face, and the distal face being generally parallel; the wall extending from the keyway spline second offset face being outset toward the distal face from the wall extending from the keyway spline first offset face;

wherein the first panel is a finished exterior face;

wherein the panel height is generally consistent and is defined by a generally horizontal top plate face and a generally horizontal bottom bearing face;

wherein the finished exterior face extends above the top plate face and extends below the bottom bearing face;

wherein the finished exterior face is:

partially outset from the keyway receiver to form a lap joint spline; and partially inset from the keyway spline to form a lap joint receiver; and wherein the wall extending from the keyway receiver first offset face is longer than the wall extending from the keyway receiver second offset face.

* * * * *